US012102155B2

(12) United States Patent
Miller

(10) Patent No.: US 12,102,155 B2
(45) Date of Patent: Oct. 1, 2024

(54) SWIMMING HEAD CAP

(71) Applicant: Trish Miller, Atlanta, GA (US)

(72) Inventor: Trish Miller, Atlanta, GA (US)

( * ) Notice: Subject to any disclaimer, the term of this patent is extended or adjusted under 35 U.S.C. 154(b) by 0 days.

(21) Appl. No.: 17/470,146

(22) Filed: Sep. 9, 2021

(65) Prior Publication Data

US 2021/0401101 A1 Dec. 30, 2021

Related U.S. Application Data

(63) Continuation-in-part of application No. 16/820,629, filed on Mar. 16, 2020, now abandoned.

(60) Provisional application No. 62/818,708, filed on Mar. 14, 2019.

(51) Int. Cl.
*A42B 1/12* (2006.01)

(52) U.S. Cl.
CPC ..... *A42B 1/12* (2013.01)

(58) Field of Classification Search
CPC ..... A63B 33/00; A42B 1/12; A42B 1/049; A45D 8/40
See application file for complete search history.

(56) References Cited

U.S. PATENT DOCUMENTS 1,516,380 A 11/1924 Genevieve
2,063,232 A 12/1936 Davies
2,497,892 A * 2/1950 Klar ..... A42B 1/12 D2/880
2,520,049 A * 8/1950 Moore ..... A42B 1/12 2/68
2,528,980 A * 11/1950 Spanel ..... A42B 1/12 450/97
2,726,398 A 12/1955 Cooper
2,730,720 A * 1/1956 Saunders ..... A42B 1/12 2/68
3,009,159 A * 11/1961 Emmet ..... A42B 1/12 2/171.01
3,120,003 A * 2/1964 Neustadter ..... A42B 1/12 D2/867
3,206,761 A * 9/1965 Melnikoff ..... A42B 1/12 2/171.01
3,447,164 A 6/1969 Greenhouse
3,714,670 A * 2/1973 Pollack ..... A42B 1/12 2/918

(Continued)

*Primary Examiner* — Alissa L Hoey
(74) *Attorney, Agent, or Firm* — Johnson | Dalal; Mark C. Johnson

(57) ABSTRACT

A swimming head cap configured to provide a substantially watertight seal and avoid pulling a user's hair and skin during removal comprising an outer layer with an outer surface, an inner surface defining a head cavity, and an outer perimeter edge defining a cap opening spatially coupling the cap opening with the head cavity, the head cavity and the cap opening operably configured to receive a user's head therein; and an annular-shaped elastic band of a polyurethane material directly coupled to the inner surface of the outer layer proximal to the outer perimeter edge and with an outer band surface having a silicone adhesive material continuously and circumferentially disposed thereon. The swimming head cap may further comprise a cap band coupled to the outer perimeter edge of the outer layer and including two cap band straps selectively removably couplable to the outer cap band surface with a hook-and-loop coupling configuration.

13 Claims, 6 Drawing Sheets

(56) References Cited

U.S. PATENT DOCUMENTS 3,793,110 A * 2/1974 Saunders ..... B29C 66/004 156/289
3,852,823 A * 12/1974 Jones ..... A42B 1/12 428/41.9
4,011,598 A 3/1977 Sherr
4,468,815 A * 9/1984 Pellegri ..... A42B 1/12 2/237
6,052,825 A 4/2000 Dodd
6,088,832 A * 7/2000 Newman ..... A42B 1/12 2/238
6,560,784 B2 5/2003 Hill
7,472,428 B2 1/2009 Van Atta
9,398,780 B1 7/2016 Matallana
9,538,799 B2 * 1/2017 Dodd ..... A42B 1/12
9,555,288 B1 1/2017 Lucas
10,021,930 B2 * 7/2018 De Jesu ..... A42B 1/12
10,039,334 B2 * 8/2018 Thompson-Buist ... A42B 1/049
10,661,122 B1 * 5/2020 Banks ..... A63B 33/00
11,388,937 B2 * 7/2022 Nachawati ..... A41D 31/02
2004/0237171 A1 * 12/2004 Greene ..... A42B 1/012 2/209
2004/0261153 A1 12/2004 Johnson
2008/0141431 A1 6/2008 Rance
2009/0019615 A1 * 1/2009 Young ..... A41B 13/10 2/49.1
2013/0298929 A1 11/2013 Cole
2014/0026284 A1 1/2014 Yates
2014/0101821 A1 4/2014 Dammann
2014/0109281 A1 * 4/2014 Waller ..... A42B 1/12 2/68
2015/0000002 A1 1/2015 Brown
2015/0135392 A1 5/2015 Bono
2015/0150327 A1 6/2015 Scott
2015/0157077 A1 * 6/2015 Stricker, Jr. ..... A42B 1/08 2/414
2016/0066639 A1 3/2016 Brown
2016/0100648 A1 4/2016 De Jesu
2016/0120254 A1 * 5/2016 Montoya ..... A42B 1/22 2/68
2016/0206072 A1 * 7/2016 Rich ..... A45D 20/00
2016/0227846 A1 8/2016 Funk
2016/0339286 A1 11/2016 Kehler
2017/0354195 A1 12/2017 Gelberg
2017/0360138 A1 12/2017 Guice
2018/0020743 A1 * 1/2018 Moore ..... A41B 13/10 2/49.1
2018/0027912 A1 2/2018 Borras
2018/0317586 A1 * 11/2018 De Jesu ..... A42B 1/12
2019/0014845 A1 1/2019 Sokoloff
2019/0330773 A1 10/2019 Hanson
2019/0381360 A1 12/2019 Yeomans
2020/0000644 A1 1/2020 Kastros
2020/0060372 A1 2/2020 Bonhomme
2020/0138120 A1 * 5/2020 Brazdo ..... A41B 13/10
2020/0260808 A1 8/2020 Waldman
2020/0288804 A1 9/2020 Westbrook
2020/0391083 A1 12/2020 Vega
2021/0361014 A1 * 11/2021 Bono ..... A42B 1/225
2022/0142280 A1 * 5/2022 Samma ..... A42B 1/22

* cited by examiner

SWIMMING HEAD CAP

CROSS-REFERENCE TO RELATED APPLICATION

This application claims priority to U.S. Provisional Patent Application No. 62/818,708, filed Mar. 14, 2019, the entirety of which is incorporated by reference.

FIELD OF THE INVENTION

The present invention relates generally to swimming head caps, and, more particularly, relates to a swimming head cap configured to provide a substantially watertight seal that prevents water from seeping in and wetting the user's hair, while also sparing the user considerable physical pain and discomfort when the user removes the swimming head cap.

BACKGROUND OF THE INVENTION

The consumer marketplace features a large variety of swimming head caps designed to keep hair out of the pool or other body of water, keep hair out of the user's face, and/or create a more hydrodynamic surface. Existing prior art, however, fails to adequately prevent water from seeping through the swimming head cap and results in a painful pulling of a user's hair upon application and removal of the cap, which is typically caused by the latex or silicone material composition of such prior art. The tension generated when a user stretches the swimming head cap over their scalp ensures a very tight fit over the scalp. It is this tight fit that both keeps a user's hair out of a user's face and out of the pool (or other body of water) but also creates painful pulling of the user's hair upon application and removal of the cap. Although these head caps achieve their intended purpose, they cost the user considerable physical pain and discomfort in the process.

Therefore, a need exists to overcome the problems with the prior art as discussed above.

SUMMARY OF THE INVENTION

The invention provides a swimming head cap that overcomes the hereinafore-mentioned disadvantages of the heretofore-known devices and methods of this general type and that is effectively and efficiently configured to couple with a user's head in a substantially watertight configuration unlike any known swimming head cap, while substantially maintaining the integrity of a user's hair disposed within the swimming head cap. Although the invention is illustrated and described herein as embodied in a swimming head cap, it is, nevertheless, not intended to be limited to the details shown because various modifications and structural changes may be made therein without departing from the spirit of the invention. Additionally, well-known elements of exemplary embodiments of the invention will not be described in detail or will be omitted so as not to obscure the relevant details of the invention.

With the foregoing and other objects in view, there is provided, in accordance with the invention, a swimming head cap comprising an outer layer with an outer surface, an inner surface opposing the outer surface and defining a head cavity, and an outer perimeter edge defining a cap opening spatially coupling the cap opening with the head cavity, the head cavity and the cap opening operably configured to receive a user's head therein; and an annular-shaped elastic band of a polyurethane material directly coupled to the inner surface of the outer layer proximal to the outer perimeter edge and with an outer band surface having a silicone adhesive material continuously and circumferential disposed thereon.

In accordance with another feature, the annular-shaped elastic band is bonded to inner surface of the outer layer.

In accordance with a further feature of the present invention, the annular-shaped elastic band includes a band width separating an upper band edge and a lower band edge opposing the upper band edge, the band width having a maximum length of approximately 4 inches.

In accordance with one embodiment of the present invention, the annular-shaped elastic band further comprises a midpoint axis spanning through the band width, the upper and lower band edges of the annular-shaped elastic band of a non-linear shape and the band width tapering in length in opposing directions from the midpoint axis.

In accordance with another embodiment, the annular-shaped elastic band is symmetrically shaped with respect to the midpoint axis.

In yet another embodiment, the outer layer further comprises a front end and a rear end opposing the front end of the outer layer, wherein the midpoint axis is disposed at the rear end of the outer layer.

In accordance with a further feature of one embodiment, the silicone adhesive material disposed on the outer band surface is of a thermoplastic silicone adhesive material.

In accordance with yet another feature, the swimming head cap further comprises a liner selectively removably coupled and surrounding to the outer band surface.

In accordance with a further feature of the present invention, the outer layer is of a fabric material and includes a plurality of pleats each surrounding a circumference thereon.

In accordance with another embodiment of the present invention, the outer surface of the outer layer includes a laminated thermoplastic polyurethane thereon.

In accordance with another feature, the inner surface of the outer layer is of a fabric material defining at least 80% of an inner surface area defining the head cavity.

In accordance with yet another feature of the present invention, the inner surface area defining the head cavity is completely of a fabric material from a joint defined by an upper band edge of the annular-shaped elastic band.

In accordance with another embodiment of the present invention, the swimming head cap further comprises a cap band coupled to the outer perimeter edge of the outer layer and including an outer cap band surface, a first cap band side, a second cap band side opposing the first cap band side, and two cap band straps each with a free end and a cap band strap inner surface selectively removably couplable to the outer cap band surface with a hook-and-loop coupling configuration.

In accordance with an alternate embodiment, the swimming head cap comprises an outer layer with an outer surface, an inner surface opposing the outer surface and defining a head cavity, and an outer perimeter edge defining a cap opening spatially coupling the cap opening with the head cavity, the head cavity and the cap opening operably configured to receive a user's head therein; and an annular-shaped elastic band directly coupled to the inner surface of the outer layer proximal to the outer perimeter edge and with an outer band surface continuously and circumferentially disposed thereon.

Although the invention is illustrated and described herein as embodied in a swimming head cap, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the swimming head cap. The term "traverse" should be understood to mean in a direction horizontally across the swimming head cap.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
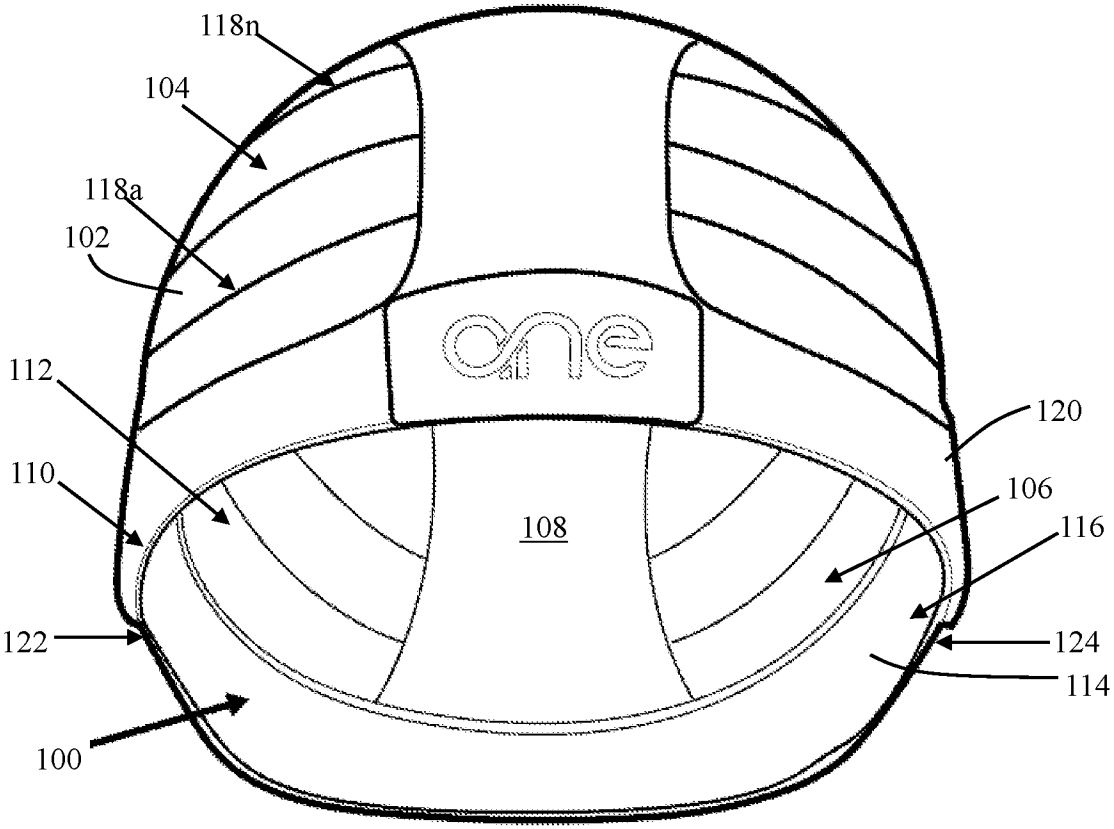
FIG. 1 is a perspective bottom view of an exemplary swimming head cap, in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient swimming head cap of a material composition that keeps a user's hair substantially dry during use and that substantially prevents the painful pulling or tugging of a user's hair and scalp upon application and removal of the cap. In contrast to existing swimming head caps, the present invention achieves its intended function, e.g., providing a watertight seal that prevents water from seeping in and wetting the user's hair, while also sparing the user considerable physical pain and discomfort when the user removes the swimming head cap.

Figure 2:
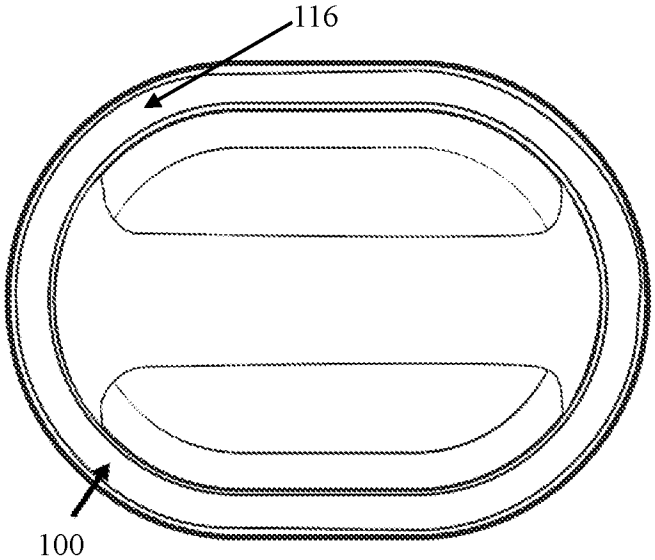
FIG. 2 is a bird's eye top view of a swimming head cap, in accordance with the present invention.

Referring now to FIG. 1 and FIG. 2, one embodiment of the present invention is shown in a perspective bottom view of an exemplary swimming head cap 100. FIG. 1 shows several advantageous features of the present invention, but, as will be described below, the invention can be provided in several shapes, sizes, combinations of features and components, and varying numbers and functions of the components. The first example of a swimming head cap 100, as shown in FIG. 1, includes an outer layer 102 with an outer surface 104, an inner surface 106 opposing the outer surface 104 and defining a head cavity 108, and an outer perimeter edge 110 defining a cap opening 112 spatially coupling the cap opening 112 with the head cavity 108, the head cavity 108 and the cap opening 112 operably configured to receive a user's head therein. In preferred embodiments, the outer layer 102 is of a fabric material and includes a plurality of pleats 118*a-n*, wherein "n" refers to any number greater than one, each surrounding a circumference thereon. The plurality of pleats 118*a-n* are operably configured to beneficially provide greater flexibility and adjustability of the swimming head cap 100 and to substantially also compensate/account for voluminous hair. In an exemplary embodiment, the circumference formed by the outer layer 102 is approximately 21.5 inches but may range between 20 and 23 inches in alternate embodiments. The circumference is operably configured to be large enough to receive and snugly fit around any user's head during use. In preferred embodiments, the fabric material of the outer layer 102 is comprised of a polyethylene terephthalate, also commonly referred to as polyester, fabric with properties including durability, moisture-resistance, and shape retention. Polyester fabric is a synthetic material made from the polymerization of petroleum-derived ethylene glycol and purified terephthalic acid, which melt down to produce polyethylene terephthalate (PET). Polyester fibers are incredibly strong, meaning they do not tear, stretch, or pill easily like cotton and other natural fibers. This strength means polyester clothing can easily handle abrasion from machine-washing and does not require special care. The durability of polyester fabric has made it especially popular for outdoor clothing. Polyester fibers substantially resist liquid droplets, meaning that the fabric will wick away moisture rather than soak it up—making it a popular material for outdoor clothing and gear that need to keep off rain and precipitation. In alternate embodiments, the outer layer 102 may be of a nylon and spandex blend, a polyester and spandex blend, a cotton and spandex blend, or a regenerative fiber and spandex blend. As used herein, spandex refers to the elastic synthetic fiber that is also generally known as lycra or elastane and is comprised of polyether-polyurea copolymer fabrics; nylon refers to a family of synthetic polymers based on aliphatic or semi-aromatic polyamides; polyester generally refers to a type of polymer called polyethylene terephthalate. The entire swimming head cap 100 may be folded or laid down in a substantially planar form, wherein planar is defined as flat or two-dimensional. In one embodiment of the present invention, the outer layer 102 is of a thickness ranging from 25-1110 microns and of a hardness ranging from 5-70 shore A.

In one embodiment, the inner surface 106 of the outer layer 102 is of a fabric material defining at least 80% of an inner surface area defining the head cavity 108. By defining at least 80% of the inner surface area of the head cavity 108, the fabric material of the inner surface 106 directly encapsulates a user's head and hair, if any, to substantially prevent the pulling, tugging, plucking, or tearing of a user's hair when placing the swimming head cap 100 on a user's head, adjusting the swimming head cap 100, or taking the swimming head cap 100 off after use. This beneficially improves the comfort of wearing and using the swimming head cap 100 and differentiates the present invention from existing prior art. After insertion of the user's head within the head cavity 108, the distal end of the annular-shaped elastic band 114 or outer layer 102 reduces in diameter and frictionally retains a circumference of a user's head (as those of skill in the art will appreciate). In an alternate embodiment, the inner surface area defining the head cavity 108 is completely of a fabric material from a joint defined by an upper band edge 406 of the annular-shaped elastic band 114. This feature beneficially achieves the same function of substantially covering the user's head and hair with the fabric material to minimize and reduce instances of pulling, tugging, plucking, or tearing of a user's hair. In some embodiments, the inner surface 106 may be of an elastically deformable material, e.g., silicone, polyurethane, acrylic, etc. As used herein, elastically deformable is defined as flexible and capable of being reshaped. Silicone, polyurethane, and acrylic are materials characterized by a low coefficient of friction, wherein a low coefficient of friction is defined as one ranging approximately between 0.15 to 2.5, though this coefficient is subject to change in different embodiments of the present invention. A low coefficient of friction facilitates a more stable and consistent grip of the swimming head cap 100 on the user's head and hair, wherein the swimming head cap 100 remains securely on the user's head without slipping or sliding off. Silicone, polyurethane, and acrylic materials are conducive to maintaining the integrity of a user's hair. Said another way, the material of the inner surface 106 resists the possibility or occurrence of hair sticking to or rubbing against the head cap.

In accordance with a further feature, the outer layer 102 of the swimming head cap 100 may also comprise a water-resistant layer operably configured to repel, resist, or prevent absorption of water so as to keep a user's head and hair, i.e., everything proximally disposed within the head cavity 108 during use, substantially dry. In one embodiment, the outer surface 104 of the outer layer 102 includes a laminated thermoplastic polyurethane (TPU) thereon. TPU is any of a class of polyurethane plastics with various properties, including elasticity, transparency, and resistance to oil, grease, water, and abrasion. Technically, they are thermoplastic elastomers consisting of linear segmented block copolymers composed of hard and soft segments. Properties of commercially available TPU include high abrasion resistance, low-temperature performance, high shear strength, high elasticity, transparency, and oil, water and grease resistance. TPU may be joined to the outer surface 104 of the outer layer 102 using a variety of lamination methods including, without limitation, flame lamination, adhesive lamination, hot-melt lamination, and solvent lamination. Flame lamination employs an open flame to bond film to soft polyurethane foams, which are often subsequently processed by die-cutting. Adhesive lamination relies on hot-melt adhesives for smooth, flexible and temperature-resistant adhesion. Hot-melt lamination is ideal for bonding films with woven, non-woven, and knitted fabrics, as well as other substrates. Solvent lamination fuses the fabric and polyurethane film into a single monolithic fabric. In alternate embodiments, rather than comprising the outer layer 102 and the laminated TPU thereon, the outer layer 102 is a polyurethane laminate (PUL) with a film thickness ranging from 25-500 microns (though in other embodiments it may be outside of said range) which achieves the intended functions of both the outer layer 102 and the TPU. PUL is a polyester fabric laminated with TPU to make it substantially water-resistant and lightweight. Most PUL fabric is made by laminating lightweight polyester interlock knit fabric to a 1-millimeter-thick film of polyurethane. The lamination may be in the form of flame lamination, adhesive lamination, hot-melt lamination, or solvent lamination. Regardless of whether TPU, PUL, or another substantially similar fabric material is used, this substantially water-resistant layer on the swimming head cap 100 is operably configured and designed to substantially prevent the influx of water into the head cavity 108 and/or the absorption of water by the outer layer 102 during use such that a user's head and hair remains substantially dry during water activities, e.g., swimming, diving, etc. The outer layer 102 may be compliant with an ASTM D4964 test at 100N or 22.5 lbs.

and have the following properties or characteristics: 3 Flex. % Elongation length Range 20%-300%, % Elongation width Range 20%-300%.

In accordance with a further feature of an exemplary embodiment of the present invention, the swimming head cap 100 further comprises an annular-shaped elastic band 114 of a polyurethane material directly coupled to the inner surface 106 of the outer layer 102 proximal to, i.e., at, near, or within 0.5 inches of, the outer perimeter edge 110 and with an outer band surface 116 (as depicted in FIG. 2) having a silicone adhesive material continuously and circumferentially disposed thereon. Polyurethane is a polymer composed of organic units joined by carbamate (urethane) links. The classification of hardness for polyurethane relies on the prepolymer's molecular structure and can be manufactured from 20 SHORE A to 85 SHORE D. Polyurethanes possess high tear resistance along with high tensile properties. Polyurethane's material properties will remain stable (with minimal swelling) in water, oil and grease. The foregoing properties and characteristics make polyurethane an ideal constituent for the annular-shaped elastic band 114 though in alternate embodiments, the annular-shaped elastic band 114 may be of a different, substantially comparable material composition. The annular-shaped elastic band 114 is operably configured to fit on and around a user's forehead and/or hair line around the circumference of the user's head such that all of a user's hair is encapsulated within the head cavity 108 and protected from water. The material composition of the annular-shaped elastic band 114 and the outer band surface 116 assists in creating a snug and watertight configuration of the swimming head cap 100 around the user's head that does not painfully tug or pull on a user's hair during removal. The outer band surface 116 may be of a silicone adhesive or sealant material, or another substantially comparable material. Silicone adhesives remain highly elastic at low temperatures, −100° F. (−75° C.), and also have very good temperature stability; up to 390° F. (200° C.) continuous exposure and up to 575° F. (300° C.) for short periods. The properties of silicones remain virtually unchanged over this temperature range. Silicones are nearly inert to chemicals and have excellent resistance to moisture and weathering, making them preferable for the outer band surface 116. In an exemplary embodiment, the silicone adhesive material disposed on the outer band surface 116 is of a thermoplastic silicone adhesive material. The annular-shaped elastic band 114 is bonded to the inner surface 106 of the outer layer 102. In one embodiment, the annular-shaped elastic band 114 and the inner surface 106 are chemically bonded to one another, e.g., using an adhesive, solvent, or through welding, to form a monolithic body. In another embodiment, the annular-shaped elastic band 114 and the inner surface 106 are mechanically bonded, e.g., using fasteners, clips, etc.

The elastic band 114 is annular, or circular, in shape and form to facilitate a closer and more comfortable fit around the user's head. In other words, the annular shape of the elastic band 114 is designed to mirror the generally annular shape of a user's head. This configuration creates a closer fit between the swimming head cap 100 and the user's head, thereby reducing the amount of free space between the two. In turn, this allows the swimming head cap 100 to have a more effective grip on the user's head, providing a watertight seal around the user's head. In an exemplary embodiment, the annular-shaped elastic band 114, when in use, will fall somewhere around the user's upper forehead and span around the circumference of the user's head. In other embodiments, the annular-shaped elastic band 114 wraps around the circumference of a user's head and serves the function of a headband that does not painfully pull or tug the user's hair and skin when in use or during removal.

Figure 4:
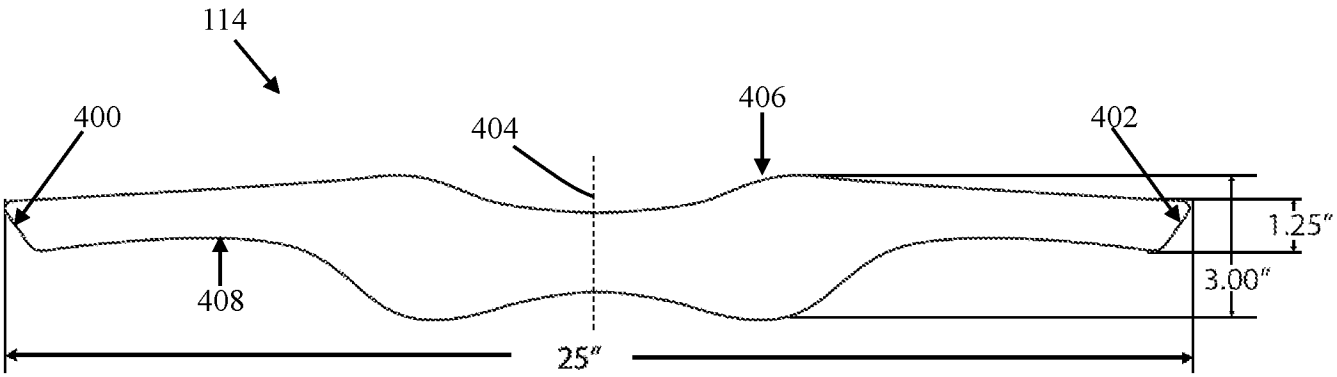
FIG. 4 is an elevational front view of an annular-shaped elastic band, in accordance with an exemplary embodiment of the present invention.

In an exemplary embodiment of the present invention, and as best seen in FIG. 4, the annular-shaped elastic band 114 includes a band width separating an upper band edge 406 and a lower band edge 408 opposing the upper band edge 406, the band width having a maximum length of approximately 4 inches to beneficially adhere to the skin around the circumference of the head, thereby serving a gripping, retaining, or adhering function, i.e., adhesion of the swimming head cap 100 to the user's head during physical water activities, while simultaneously being short enough not to cover the user's eyes, interfering with the user's vision and comfort during use of the swimming head cap 100. In a preferred embodiment, the annular-shaped elastic band 114 has an exemplary band length of 25 inches, though the band length may range between approximately 23 and 27 inches in alternate embodiments to accommodate varying head circumferences of a user's head. The swimming head cap 100 is approximately between 7 inches and 8 inches in height and has an exemplary height of 7.6 inches.

The annular-shaped elastic band 114 further comprises a midpoint axis 404 spanning through the band width, the upper and lower band edges 406, 408 of the annular-shaped elastic band 114 of a non-linear shape and the band width tapering in length in opposing directions from the midpoint axis 404. In one embodiment, the non-linear shape is continuously non-linear and in other embodiments there may be portions or sections with a linear shape. The tapering band width may range between approximately 1 inch and 3 inches. Testing and research have shown that the tapering width minimizes hair bunching and pulling, while increasing adhesion to the user's skin/head (less surface area needed on user's skin, while rear of cap—where a user's hair is, requires more surface area). The annular-shaped elastic band 114 is preferably symmetrically shaped with respect to the midpoint axis 404 to reflect the natural symmetry of the anatomical make-up of a user's head and face.

Figure 6:
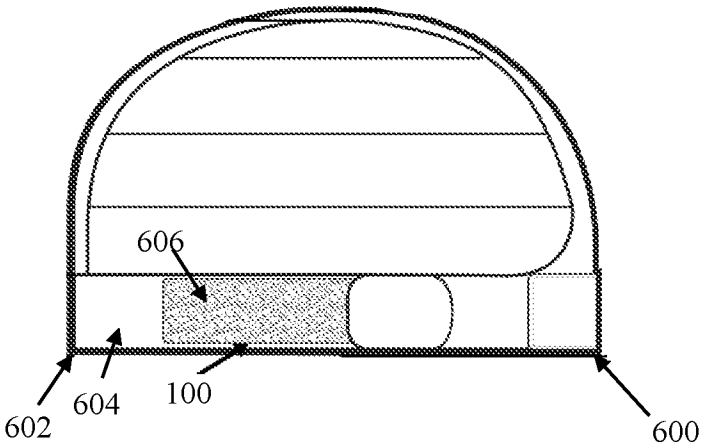
FIG. 6 is an elevational side view of the swimming head cap, in accordance with the present invention.

As best depicted in FIG. 4 and FIG. 6, the outer layer 102 further comprises a front end 600 and a rear end 602 opposing the front end 600 of the outer layer 102, wherein the midpoint axis 404 is disposed at the rear end 602 of the outer layer 102. The midpoint axis 404 is characterized by a thicker band width than the upper and lower band edges 406, 408 of the annular-shaped elastic band 114 and is proximally disposed on the rear of a user's head, i.e., where the thicker band width is needed to support, retain, and encapsulate the area of the head typically characterized by the most quantity of hair.

Figure 3:
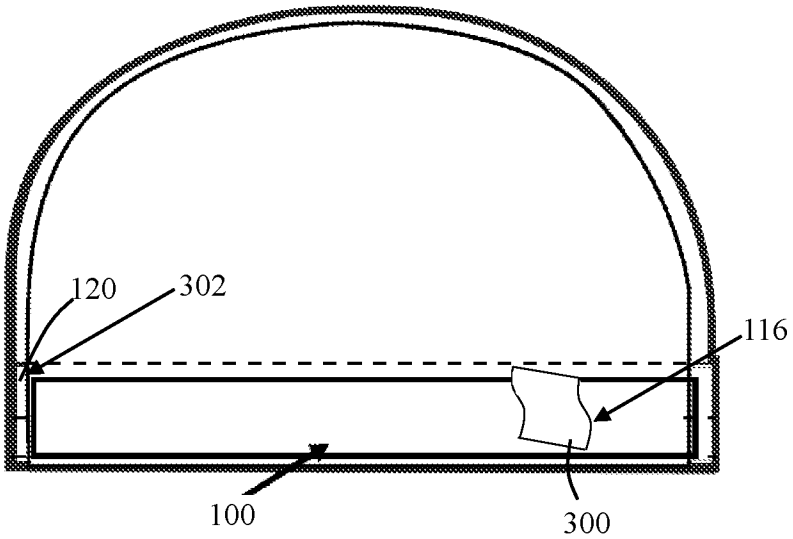
FIG. 3 is an elevational side view of the inside cavity of a swimming head cap, in accordance with the present invention.

In accordance with a further feature of an exemplary embodiment, the swimming head cap 100 also comprises a release liner 300 (best depicted in FIG. 3) selectively removably coupled to, and surrounding, the outer band surface 116. A release liner is a paper or plastic-based film sheet (usually applied during the manufacturing process) used to prevent a sticky surface from prematurely adhering, i.e., designed to prevent the silicone adhesive material of the outer band surface 116 from prematurely adhering to unintended surfaces unless and until a user removes the release liner 300. Release liners, also commonly referred to as "carriers" or "backing" paper or film, are products that carry a sticky substrate (pressure sensitive adhesive) until they are ready for their next step. Release liners can be film-based, paper-based, polycoated-paper based, or even have unique substrates, such as metallized papers/films as their base. Release liner substrates are often coated with silicone, which allows whatever the liner is carrying to release when the time is right. This release can also be accomplished with non-silicone coatings or even with a surface characteristic of the substrate that does not require a coating at all.

Figure 5:
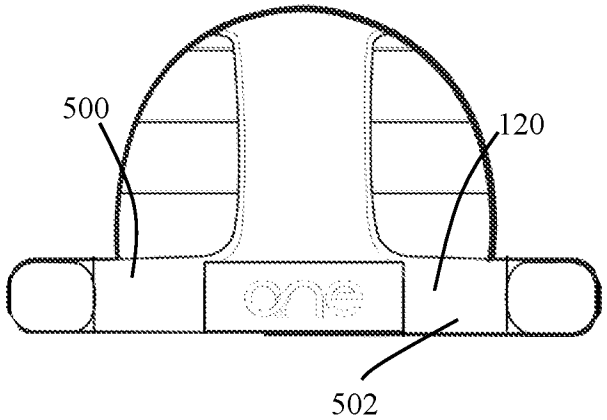
FIG. 5 is an elevational front view of a swimming head cap, in accordance with an exemplary embodiment of the present invention.

As best depicted in FIG. 1 and FIG. 5, the swimming head cap 100 may also comprise a cap band 120 coupled to the outer perimeter edge 110 of the outer layer 102 and including an outer cap band surface 604, a first cap band side 122, a second cap band side 124 opposing the first cap band side 122, and two cap band straps 500, 502 each with a free end and a cap band strap inner surface (e.g., surface 302) selectively removably couplable to the outer cap band surface 604 with a hook-and-loop coupling configuration or a comparable coupling configuration, e.g., fasteners, clips, etc. The cap band 120 is selectively adjustable via the two cap band straps 500, 502 which may be tightened or loosened by a user to provide for a snugger yet comfortable fit of the swimming head cap 100 on and around a user's head. This feature beneficially improves the fit and comfort of the swimming head cap 100 while providing a user with greater customizability and adjustability. The two cap band straps 500, 502 are each approximately between 3.5 inches and 4.5 inches in length and have an exemplary length of 4 inches.

Figure 8:
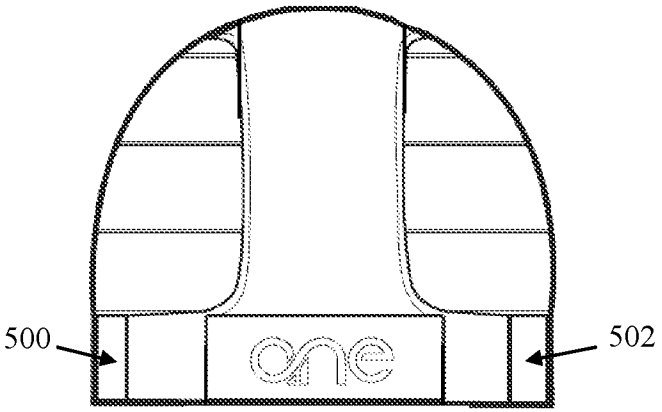
FIG. 8 is an elevational front view of a swimming head cap, in accordance with an exemplary embodiment of the present invention.
Figure 7:
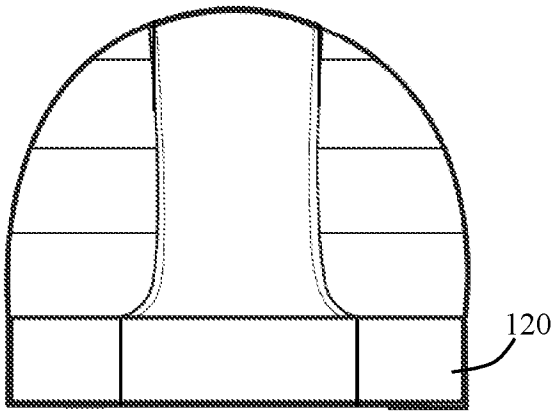
FIG. 7 is an elevational rear view of a swimming head cap, in accordance with an exemplary embodiment of the present invention.
Figure 9:
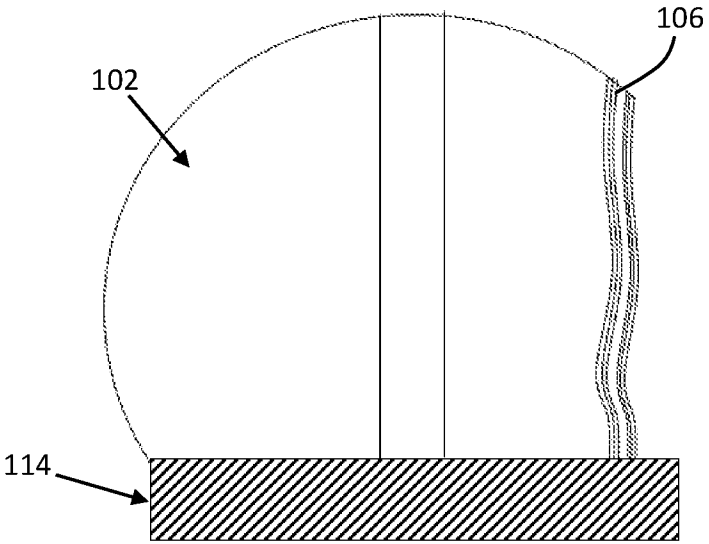
FIG. 9 is a cross-sectional view of an exemplary swimming head cap, in accordance with the present invention.

An elevational rear view of an exemplary embodiment of the swimming head cap 100 is depicted in FIG. 7 and an elevational front view is depicted in FIG. 8. A cross-sectional view of the swimming head cap 100 is depicted in FIG. 9, identifying the outer layer 102, the inner surface 106 of the outer layer 102, and the annular-shaped elastic band 114.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above-described features.

What is claimed is:

1. A swimming head cap comprising:

an outer layer of a fabric polyester non-stretch material, forming a plurality of pleats configured to provide greater adjustability of the swimming cap to accommodate voluminous hair, with an outer surface having a laminated thermoplastic material layer covering the outer layer providing a water-resistant barrier to the fabric material of the outer layer and into a head cavity, with an inner surface of the fabric polyester material having non-stretch fibers and with the inner surface defining the head cavity, wherein the inner surface opposes the outer surface of the outer layer, and with an outer perimeter edge defining a cap opening spatially coupling the cap opening with the head cavity, the head cavity and the cap opening operably configured to receive a user's head therein; and an annular-shaped elastic band of a polyurethane material directly coupled to and bonded over the inner surface of the outer layer, located proximal to the outer perimeter edge, having an upper band edge disposed inside of the head cavity, and having an outer band surface with a silicone adhesive material thereon that continuously and circumferentially surrounds the head cavity for creating a snug and watertight configuration of the swimming head cap around a user's head when worn, the inner surface of the outer layer completely formed of the fabric material in the head cavity starting from a joint defined by the inner surface and the upper band edge.

2. The swimming head cap according to claim 1, wherein:

the annular-shaped elastic band includes a band width separating the upper band edge of the annular-shaped elastic band and a lower band edge opposing the upper band edge, the band width having a maximum length of approximately 4 inches.

3. The swimming head cap according to claim 2, wherein annular-shaped elastic band further comprises:

a midpoint axis spanning through the band width, the upper and lower band edges of the annular-shaped elastic band of a non-linear shape and the band width tapering in length in opposing directions from the midpoint axis.

4. The swimming head cap according to claim 3, wherein:

the annular-shaped elastic band is symmetrically shaped with respect to the midpoint axis.

5. The swimming head cap according to claim 4, wherein the outer layer further comprises:

a front end and a rear end opposing the front end of the outer layer, wherein the midpoint axis is disposed at the rear end of the outer layer.

6. The swimming head cap according to claim 1, wherein:

the silicone adhesive material disposed on the outer band surface is of a thermoplastic silicone adhesive material.

7. The swimming head cap according to claim 1, further comprising:

a liner selectively removably coupled and surrounding to the outer band surface.

8. The swimming head cap according to claim 1, wherein:

the laminated thermoplastic material layer is of a polyurethane material thereon.

9. The swimming head cap according to claim 1, further comprising:

a cap band coupled to the outer perimeter edge of the outer layer and including an outer cap band surface, a first cap band side, a second cap band side opposing the first cap band side, and two cap band straps each with a free end and a cap band strap inner surface selectively removably couplable to the outer cap band surface with a hook-and-loop coupling configuration.

10. The swimming head cap according to claim 1, wherein:

the laminated thermoplastic material layer is of a polyurethane material having a film thickness ranging from 25-500 microns.

11. The swimming head cap according to claim 1, wherein:

the laminated thermoplastic material layer has a film thickness ranging from 25-500 microns.

12. A swimming head cap comprising:

an outer layer of a fabric polyester non-stretch material, forming a plurality of pleats configured to provide greater adjustability of the swimming cap to accommodate voluminous hair, with an outer surface having a laminated thermoplastic material layer covering the outer layer providing a water-resistant barrier to the fabric material of the outer layer and into a head cavity, with an inner surface of the fabric polyester material having non-stretch fibers and with the inner surface defining the head cavity, wherein the inner surface opposes the outer surface of the outer layer, and with an outer perimeter edge defining a cap opening spatially coupling the cap opening with the head cavity, the head cavity and the cap opening operably configured to receive a user's head therein; and an annular-shaped elastic band directly coupled to and bonded over the inner surface of the outer layer proximal to the outer perimeter edge, located proximal to the outer perimeter edge of the outer layer, having an upper band edge disposed inside of the head cavity, and having an outer band surface with a silicone adhesive material thereon that continuously and circumferentially surrounds the head cavity for creating a snug and watertight configuration of the swimming head cap around a user's head when worn, the inner surface of the outer layer completely formed of the fabric material in the head cavity starting from a joint defined by the inner surface and upper band edge.

13. The swimming head cap according to claim 12, wherein: the laminated thermoplastic material layer is of a polyurethane material.

* * * * *